US011457675B2

(12) United States Patent
Redman

(10) Patent No.: US 11,457,675 B2
(45) Date of Patent: Oct. 4, 2022

(54) HAND AND ARM PROTECTOR

(71) Applicant: Ricky Van Redman, Hudson, WI (US)

(72) Inventor: Ricky Van Redman, Hudson, WI (US)

(73) Assignee: Ricky Van Redman, Hudson, WI (US)

( * ) Notice: Subject to any disclaimer, the term of this patent is extended or adjusted under 35 U.S.C. 154(b) by 223 days.

(21) Appl. No.: 16/784,003

(22) Filed: Feb. 6, 2020

(65) Prior Publication Data

US 2020/0253300 A1 Aug. 13, 2020

Related U.S. Application Data

(60) Provisional application No. 62/802,988, filed on Feb. 8, 2019.

(51) Int. Cl.
*A41D 13/08* (2006.01)
*A63B 71/12* (2006.01)

(52) U.S. Cl.
CPC ..... *A41D 13/08* (2013.01); *A41D 2300/20* (2013.01); *A41D 2300/50* (2013.01); *A63B 71/12* (2013.01)

(58) Field of Classification Search
CPC ..... A41D 13/08; A41D 2300/50; A41D 2300/20; A41D 2300/22; A41D 2300/30; A63B 71/12; A63B 71/14; A63B 71/141; A63B 2209/10; A63B 2071/0694; A63B 2225/09
See application file for complete search history.

(56) References Cited

U.S. PATENT DOCUMENTS 348,618 A 9/1886 Converse
363,829 A 5/1887 Jennings
622,688 A 4/1899 Horn
906,856 A 12/1908 Bernard
2,904,792 A 9/1959 Elliot
3,000,378 A 9/1961 Zieman
3,559,640 A 2/1971 Beckett
3,924,272 A * 12/1975 Allen ..... A41D 13/08 2/910
4,011,596 A 3/1977 Chang
4,062,073 A * 12/1977 Rhee ..... A41D 13/08 2/16
4,190,902 A 3/1980 Rhee
4,473,614 A 9/1984 Hockmeyer
(Continued)

OTHER PUBLICATIONS

Google Search. Arm Protectors. Accessed Mar. 6, 2020. https://www.google.com/search?q=arm+protectors&rtz=1C1GCEU_enUS862US862&sxsrf=ALeKk03-CjSVwRYCn1ZOpNL8FAbnKZZIUg:158350775%E2%80%A6#spf=1588687526655.

*Primary Examiner* — Clinton T Ostrup
*Assistant Examiner* — Akwokwo Olabisi Redhead
(74) *Attorney, Agent, or Firm* — Seager, Tufte & Wickhem LLP

(57) ABSTRACT

Arm protectors may be configured to protect a forearm of a user from bruising, scratches, cuts, bites, burns, and/or other injuries. The arm protector may include a body portion having a main body portion, a hand portion, and an extension portion. The main body portion may extend between the hand portion and the extension portion. The extension portion may extend from the main body portion toward an elbow of a user on a first side and toward an elbow crease of a user on a second side so as to protect a forearm, including an elbow region, of a user, while facilitating bending of the arm of the user.

20 Claims, 5 Drawing Sheets

(56) References Cited

U.S. PATENT DOCUMENTS

| | | | | |
|---|---|---|---|---|
| D290,766 | S | 7/1987 | Pierce, Jr. | |
| 4,765,319 | A | 8/1988 | Finnieston et al. | |
| D299,562 | S | 1/1989 | Lee | |
| D300,676 | S | 4/1989 | Pierce | |
| 4,868,927 | A | 9/1989 | Bourdeau | |
| 4,873,968 | A | 10/1989 | Finneston et al. | |
| 4,942,624 | A | 7/1990 | Cho | |
| 4,967,419 | A | 11/1990 | Elliott | |
| 5,070,541 | A | 12/1991 | Goss | |
| 5,073,988 | A | 12/1991 | Lewis et al. | |
| 5,173,966 | A | 12/1992 | DeLeo | |
| 5,195,944 | A | 3/1993 | Schlogel | |
| 5,361,415 | A | 11/1994 | Deering et al. | |
| 5,402,536 | A | 4/1995 | Matthews | |
| 5,526,531 | A | 6/1996 | Olson et al. | |
| 5,642,525 | A | 7/1997 | Ketola | |
| 5,662,594 | A | 9/1997 | Rosenblatt | |
| 5,734,992 | A | 4/1998 | Ross | |
| 5,873,968 | A | 2/1999 | Pike et al. | |
| 5,878,435 | A | 3/1999 | Kast et al. | |
| 6,092,235 | A | 7/2000 | Santa Cruz et al. | |
| 6,128,777 | A | 10/2000 | Foreman | |
| D440,017 | S | 4/2001 | Pagotto | |
| 6,430,744 | B1 | 8/2002 | Redman et al. | |
| RE38,948 | E | 1/2006 | Redman | |
| 7,578,004 | B2 | 8/2009 | Loyens et al. | |
| 7,725,950 | B2 * | 6/2010 | Hinebaugh | A63B 71/14 2/16 |
| D678,536 | S | 3/2013 | Niefer | |
| 8,603,018 | B2 * | 12/2013 | Anglada | A61F 5/013 473/213 |
| 2002/0069454 | A1 | 6/2002 | Beland | |
| 2007/0028345 | A1 | 2/2007 | McCarty | |
| 2007/0119462 | A1 | 5/2007 | Shumate et al. | |
| 2007/0204373 | A1 * | 9/2007 | Loyens | A41D 31/245 2/16 |
| 2007/0234460 | A1 | 10/2007 | Castonguay et al. | |
| 2009/0000003 | A1 | 1/2009 | Hinebaugh | |
| 2009/0112143 | A1 | 4/2009 | Fournet, II | |
| 2010/0113996 | A1 | 5/2010 | Batz et al. | |
| 2010/0268135 | A1 | 10/2010 | Summit et al. | |
| 2013/0000022 | A1 | 1/2013 | Sokolowski et al. | |
| 2013/0111641 | A1 | 5/2013 | Colanto et al. | |
| 2017/0071276 | A1 | 3/2017 | McClure | |

* cited by examiner

HAND AND ARM PROTECTOR

CROSS REFERENCE TO RELATED APPLICATIONS

This application claims the benefit of U.S. Provisional Patent Application Ser. No. 62/802,988 filed on Feb. 8, 2019, the disclosure of which is incorporated herein by reference.

TECHNICAL FIELD

The present disclosure pertains to wearable arm protection devices. More particularly, the present disclosure pertains to hand and forearm protection devices.

BACKGROUND

Coverings for the hand and/or arm of a user are utilized for a variety of reasons. In some cases, hand or forearm coverings may be utilized for protection during athletics, while riding motorcycles, while repairing vehicles, while clearing brush, etc. Further, hand or forearm coverings may be used in the medical field as restraining devices (e.g., to protect a sprained wrist) and/or for bruise and scrape protection. Of the known hand or forearm coverings, each has certain advantages and disadvantages.

BRIEF SUMMARY

This disclosure provides, design, material, manufacturing method, and use alternatives for arm protectors. An example hand and forearm protector may include a main body portion configured to extend along and around a forearm of a user, a hand portion extending distally from the main body portion, an extension portion extending proximally from the main body portion and configured to extend to a location adjacent an elbow region of the user, and an edge defining a proximal edge of the extension portion, the edge having a notched section configured to receive an upper arm of the user when an arm of the user is bent at an elbow.

Alternatively or additionally to the example above, the edge may be configured to extend from a location adjacent an elbow of a user on a first side of the extension portion to a location adjacent an elbow crease of a user on a second side of the extension portion when the main body portion extends along and around the forearm of the user and fingers of a hand of the user extend through the hand portion.

Alternatively or additionally to the example above, a proximal-most edge of the extension portion may be configured to extend to a location with one (1) inch of an elbow of the user when the main body portion extends along and around the forearm of the user and fingers of a hand of the user extend through the hand portion.

Alternatively or additionally to the example above, the edge forms an angled transition between a location along the notched section and a proximal-most location along the edge.

Alternatively or additionally to the example above, the angled transition may form a smooth curve between the location along the notched section and the proximal-most location along the edge.

Alternatively or additionally to the example above, the location along the notched section may be a distal-most location along the edge.

Alternatively or additionally to the example above, the extension portion may have a length on its longest side that is within a range of 0.200 and 0.400 times a combined length of the main body portion and the hand portion.

Alternatively or additionally to the example above, the hand and forearm protector may include a lumen extending distally from the notched section of the edge and along the main body portion, and a closure mechanism configured to adjustably change a diameter of the lumen in response to adjusting the closure mechanism between an opened configuration and a closed configuration.

Alternatively or additionally to the example above, the hand and forearm protector may include a lumen extending distally along the main body portion from the notched section of the edge, and an insert connected to longitudinally extending edges of a seam, the insert may be configured to define the lumen and define the notched section.

Alternatively or additionally to the example above, the hand portion may comprise a first discrete digit opening configured to receive a plurality of fingers of the user and a second discrete digit opening configured to receive a thumb of the user.

Another example arm protector may comprise a body having a first end, a second end, a lumen extending between the first end and the second end, a first opening at the first end, the lumen configured to receive a hand and an arm of a user through the first opening, a second opening at the second end, the second opening configured to receive the hand of the user, and an edge of the body defining the first opening. The edge may extend circumferentially around the body and longitudinally along the body.

Alternatively or additionally to the example above, the edge may define a gradual transition between a distal-most point along the edge and a proximal-most point along the edge.

Alternatively or additionally to the example above, a location of the distal-most point along the edge may be circumferentially opposite a location of the proximal-most point along the edge.

Alternatively or additionally to the example above, the gradual transition may be formed by a smooth curve defined by the edge.

Alternatively or additionally to the example above, the edge may be symmetric about at least one plane extending longitudinally along the body.

Alternatively or additionally to the example above, the edge may define a notched section in the body.

Alternatively or additionally to the example above, the arm protector may further include longitudinally extending edges of the body, the longitudinally extending edges extending distally along the body from the first opening, and an insert connected to the longitudinally extending edges, the insert configured to extend between the longitudinally extending edges and define the first opening.

Alternatively or additionally to the example above, the arm protector may further include an adjustable closure mechanism configured to adjustably connect the longitudinally extending edges over the insert.

Another example protector may include a body having a first end, a second end, a lumen extending between the first end and the second end, a first opening at the first end, the lumen configured to receive a hand and an arm of a user through the first opening; and a second opening at the second end, the second opening configured to receive the hand of the user. The body may be configured to protect a forearm of the user from a location adjacent an elbow of the user to the hand of the user, while facilitating bending of the arm of the user at the elbow.

Alternatively or additionally to the example above, the protector may further include an edge of the body defining the first opening and a proximal terminal end of the body. The edge may be configured to extend from an elbow region of the user to a location adjacent an elbow crease of the user when the arm of the user is bent and maintain a configuration of a portion of the body extending to the location adjacent the elbow of the user.

The above summary of some embodiments is not intended to describe each disclosed embodiment or every implementation of the present invention. The Figures, and Detailed Description, which follow, more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
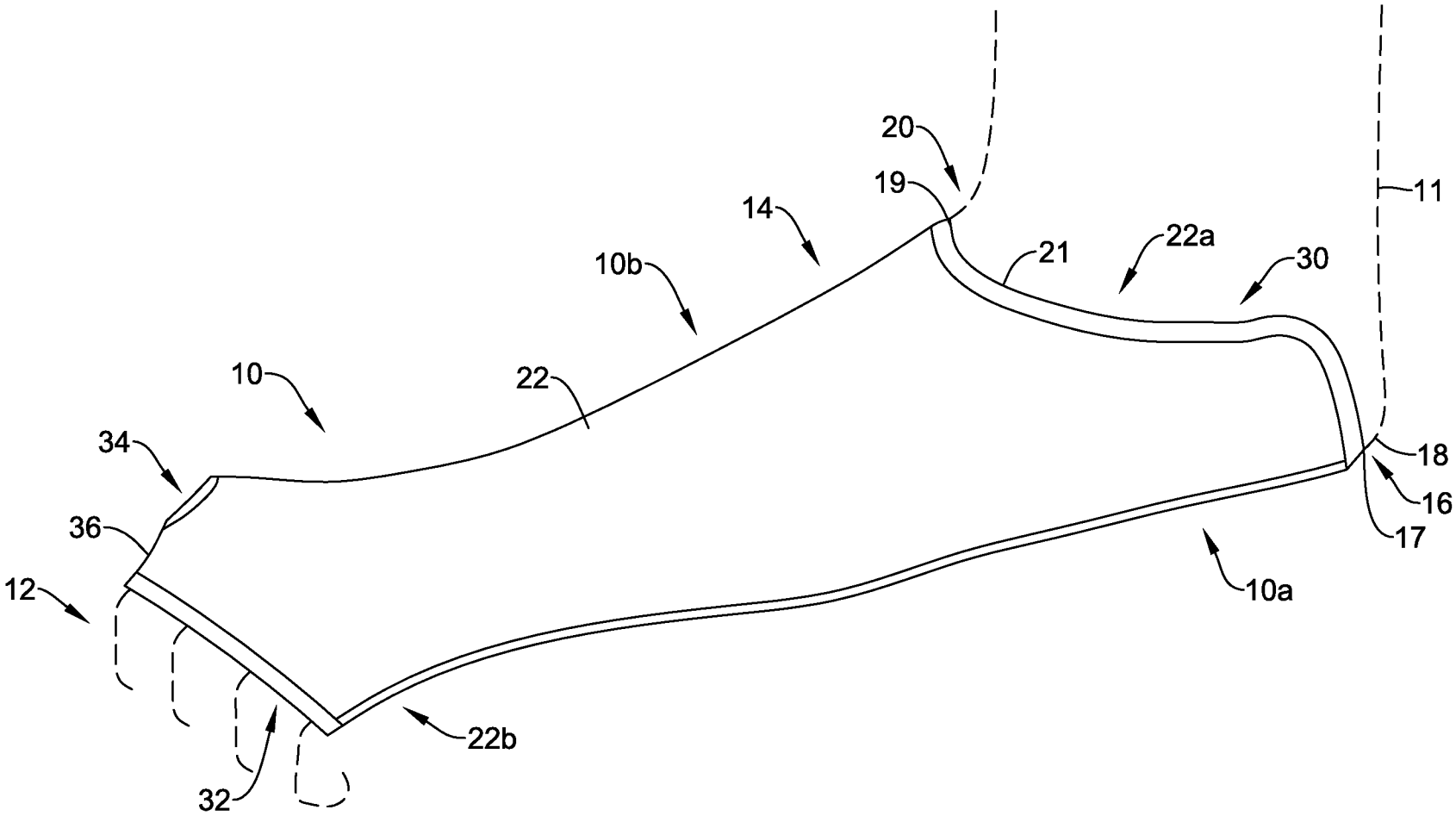
FIG. 1 is a perspective view of an example arm protector on a user's arm.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (e.g., having the same function or result). In many instances, the term "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used in connection with other embodiments whether or not explicitly described unless clearly stated to the contrary.

The following detailed description should be read with reference to the drawings in which similar elements in different drawings are numbered the same. The drawings, which are not necessarily to scale, depict illustrative embodiments and are not intended to limit the scope of the invention.

Typical arm coverings either 1) do not protect an elbow of a user or 2) do cover and/or protect the elbow, but also restrict bending of the user's arm at the elbow. Example arm coverings that are configured to protect the arm, but do not protect the elbow may be configured to protect a user's forearm and extend from a user's hand to a location along the user's forearm that is distal of the user's elbow (e.g., at least one and half (1.5) inches to two (2) inches distal of the user's elbow) or may be configured to protect a user's upper arm and extend from a user's shoulder area to a location proximal of the user's elbow region. As a result, such devices may allow a user to bend their arm at the elbow, but do not protect the user's arm at or around an elbow region of the user's arm. Example coverings that cover and/or protect an elbow may be a full-length sleeve or a sleeve that at least cover the user's arm at the elbow, above the elbow, and below the elbow while being secured to a user's arm above and below the user's elbow (e.g., secured via compression material and/or one or more straps or other connectors). In such configurations, the coverings may restrict bending of the user's elbow and may be uncomfortable due to covering an elbow crease region or an elbow crease (e.g., the crease in a user's arm that is made when the user bends its arm at the elbow) and/or being secured to the user below and above the elbow. The skin area at and/or around the elbow crease has been found to be sensitive to coverings when bending of the arm occurs throughout a task and/or day and, as a result, it is desired to have a forearm and elbow protector that does not extend over the elbow crease. As discussed below, a protector may be provided that facilitates protecting a user's forearm up to the user's elbow, while facilitating the user bending its arm at the elbow.

The protector may help in many activities/occupations, and will help people that have easy bruising issues or thin skin issues (as examples). This protector may also improve the comfort of people in many situations, including, but not limited to, when resting their arms while driving, resting their arms on a hard surface (e.g., when sitting in a chair, while sitting in wheelchairs, etc.), leaning against a hard surface, bracing your arms in tight areas doing maintenance work, working with hot surfaces and/or materials, working in cool environments, and/or in other suitable instances. When a user rests its arms and/or performs one or more tasks in which its arms may unintentionally contact an object, the elbow may take on much of the weight or pressure of the contact. For people that are aging or have health issues due to severely decreased muscle and fatty tissue in the arms, it may be particularly painful to rest their arms against a hard surface. As such, protecting the elbow and forearm areas of a user's arm and providing added cushion from at least a single layer of protective material using the protector disclosed herein will increase the comfort of the person.

Further, in addition to protecting a user's elbow and forearm area, the protector may protect a user's hand and/or wrist area by covering these areas and providing support for hand and/or wrist movements, while still allowing users to move at their hands and wrists during use of the protector (e.g., as opposed to hand and wrist supports that may prevent or limit hand and wrist movements, such as a wrist brace for carpal tunnel syndrome and/or other similar supports). The ability of a user wearing the protector to move its hand and/or wrist may facilitate a user strengthening muscles involved in movements of the hand and/or wrist while supporting the hand and/or wrist and providing protections against extreme temperatures, scratches, cuts, bruises, etc.

Turning to the Figures, FIG. 1 discloses a perspective view of a protector 10 (e.g., a hand and arm protector) on a user's arm 11 (e.g., where the user's arm is drawn in broken lines to establish an environment for the protector 10). The protector 10 may be configured to and utilized to protect at least a portion of a user's hand 12 and the user's forearm 14 up to at least an elbow region 16 of the user while also facilitating bending of the user's arm. In some cases, the protector 10 may overlap the elbow, but this is not required.

As depicted in FIG. 1, the protector 10 may extend from a user's hand 12 to an elbow region 16 at a proximal end of the user's forearm 14. The elbow region 16 may include an elbow 18 of the user and the user's forearm 14 may be considered to have a proximal terminal end at or adjacent the elbow 18 and/or may encompass a region extending a predetermined distance from the elbow.

In some cases and as discussed in greater detail below, the protector 10 may extend further proximally toward and/or beyond the elbow 18 on a first 10A of the protector 10 than on a second side 10*b* of the protector 10. For example, as depicted in FIG. 1, although the protector 10 may be configured to extend to the elbow region 16 of a user on the first side 10*a* of the protector 10 (e.g., at a first proximal terminal end 17 of the protector 10), a second side 10*b* of the protector 10 may extend to a second proximal terminal end 19, which may be configured to be at a location of, or distal of, an elbow crease 20 of the user. The elbow crease 20 may be a location along the arm 11 of the user at which a bend crease is created when the arm 11 of the user is bent at the elbow 18 (e.g., at an elbow joint). Such a configuration of the protector 10 may allow for total or near total forearm protection while also facilitating bending of the user's arm while wearing the protector 10.

The protector 10 may include a sleeve or body 22. The body 22 may include a first end portion 22*a* and a second end portion 22*b*. In one example, the first end portion 22*a* may be configured to extend proximally to locations at or around a user's elbow and elbow crease and the second end portion 22*b* may be configured to extend distally to locations at or around a first set of joints or knuckles of digits of a user's hand. However, the second end portion 22*b* may be configured to extend to a distally farther location along the user's hand, as desired. The first set of joints or knuckles of digits of a user's hand may be joints or knuckles that are formed at the articulation of the metacarpal bone and the phalange of each digit of the user's hand.

In some cases, for example to facilitate using gloves with the protector 10, the second end portion 22*b* may not extend over the first joints or knuckles of a user's hand and thus would result in exposing those first joints or knuckles of a user's hand, but this is not required. For example, when the second end portion 22*b* of the body 22 has a terminal end proximal to (e.g., at a location about one (1) inch or other suitable distance proximal to) the first joints or knuckles of digits of a user's hand, the protector 10 may allow for greater dexterity of the fingers than if the first joints or knuckles were covered. Additional and/or alternative configurations for a protector at or around a hand portion are discussed in U.S. Pat. No. 6,430,744 entitled FOREARM CHAPS and filed on Mar. 6, 2000, which is hereby incorporated by reference in its entirety for all purposes, and U.S. Pat. No. 5,878,435 entitled HAND AND FOREARM PROTECTOR and filed on Nov. 12, 1997, which is hereby incorporated by reference in its entirety for all purposes. Further, when the protector 10 is used with gloves, the protector may be configured to provide coverage for a wrist of a user to protect against extreme temperatures, bruising, scratching, cuts, etc. by providing a covering between the glove on a hand of user and a shirt or jacket worn by the user.

In some cases, the first end portion 22*a* of the body 22 may include, or otherwise define, one or more openings (e.g., a proximal opening and/or other suitable openings) and the second end portion 22*b* of the body 22 may include one or more openings (e.g., one or more distal openings). Additional or alternative openings may be located in or along the body 22 of the protector 10, as desired.

In some cases, the one or more openings at the first end portion 22*a* of the body 22 may include a first opening 30. The first opening 30 may be configured to receive a user's hand 12 and forearm 14 and, when a user is wearing the protector 10, the arm of the user may extend out of the first opening 30 in the proximal direction. Additional and/or alternative openings may be located at and/or adjacent to the first end portion 22*a* of the body 22, as desired.

The one or more openings at the second end portion 22*b* of the body 22 may include a single opening configured to receive all of the digits of a user's hand or two or more openings each configured to receive a subset of digits of a user's hand. In one example, the one or more openings at the second end portion 22*b* of the body 22 may include a second opening 32 and/or a third opening 34. As depicted in the Figures, the second opening 32 and the third opening 34 may be separated by a section 36 of material forming the protector 10.

The second opening 32 may be configured to receive one or more digits of the hand 12 of the user. In some cases, as depicted in FIG. 1, the second opening 32 may be configured to receive four digits (e.g., a little finger digit, a ring finger digit, a middle finger digit, and a pointer finger digit). Further, the third opening 34 may be configured to receive one or more digits of the hand 12 of the user. In some cases, the third opening 34 may be configured to receive a thumb digit of a user. Although the one or more openings at the second end portion 22*b* of the body 22 are discussed herein as including one opening for receiving four finger digits of a hand and one opening for receiving the thumb digit of a hand, the second end portion 22*b* may include additional and/or alternative openings and/or arrangements of openings. Further, in some cases, the one or more openings at the second end portion 22*b* may be configured to receive portions of a hand or arm of a user that are proximal to the digits of the user's hand.

The body 22 of the protector 10 may be formed from any suitable material. In some instances, the body 22 may formed from a flexible continuous piece of material. The material forming the body 22 may be pliable, wear resistant, and/or suitable for use outdoors, but this is not required. In one example, the material of the body 22 may be leather. Additional and/or alternative materials are contemplated.

The body 22 of the protector 10 may be formed from any suitable number of pieces of materials and/or layers. In some cases, the body 22 may be formed from one or more pieces of material. For example, the body 22 may be formed from a single piece of material cut and/or sewn to have the configurations of the protectors 10 depicted in the Figures. Alternatively, the body 22 may be formed from two or more pieces of material cut and/or sewn to have the configuration of the protectors 10 depicted in the Figures. Further, in some cases, the body 22 may include trim material around edges (e.g., edges exposed to a user's skin and/or other suitable edges) and/or decorative material and/or indicia.

In one example configuration of the protector 10, the body 22 may be formed from three primary pieces of material. A first piece of material and a second piece of material may be cut and sewn to define a seam at the first side 10*a* of the protector 10, along with the second opening 32 and the third opening 34 discussed above. A third piece of material may be utilized to connect the first piece of material and the second piece of material, as discussed in greater detail below. Generally, such a configured protector 10 may be a single layer of material, but additional layers may be at one or more locations on the protector 10, as desired.

Figure 2:
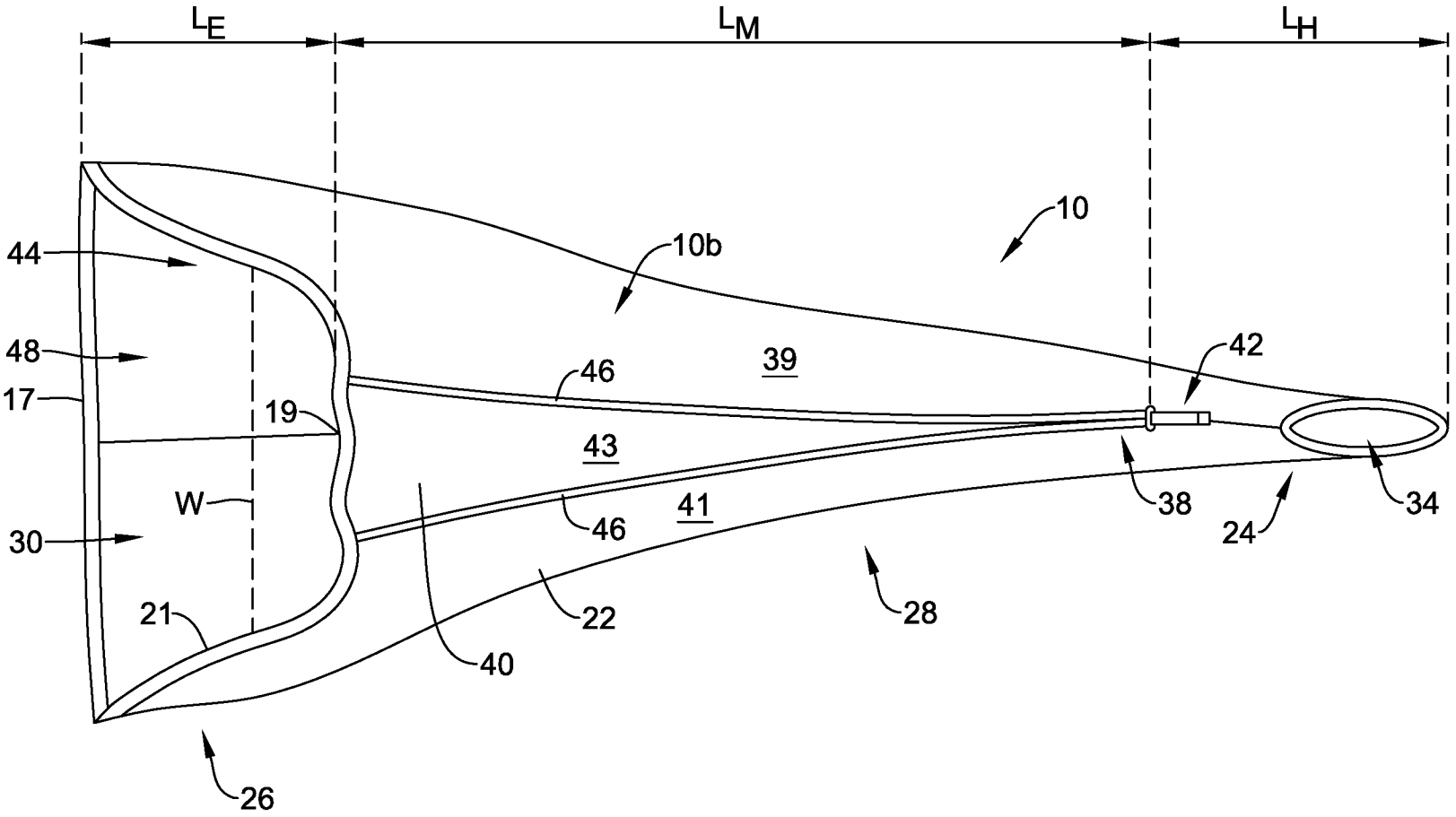
FIG. 2 is a side view of an example protector in an opened configuration.
Figure 3:
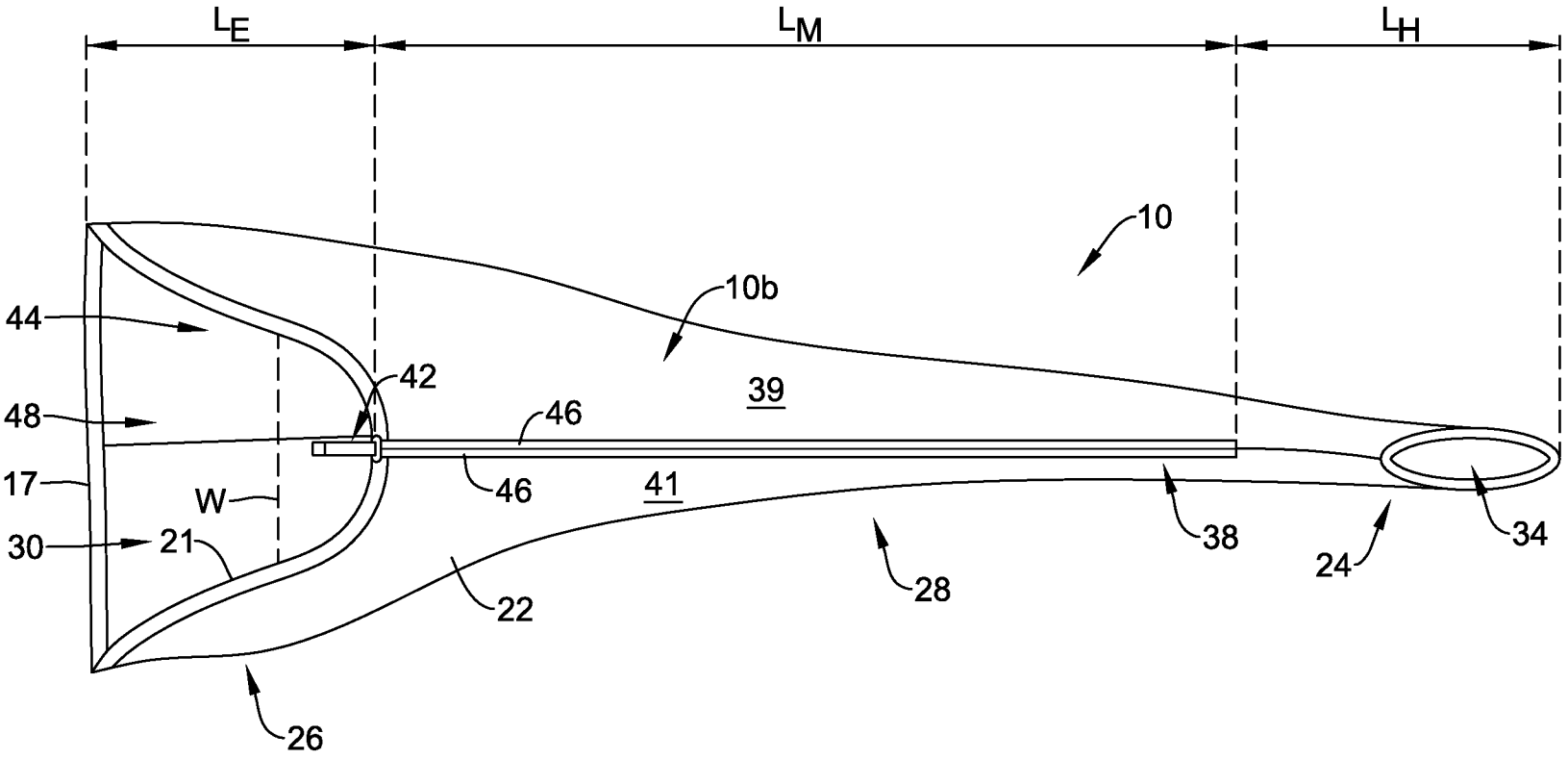
FIG. 3 is a side view of an example protector in a closed configuration.

FIGS. 2 and 3 depict the protector 10 in a side view (e.g., showing the second side 10*b* of the protector 10). In some cases, the body 22 may have a hand portion 24 (e.g., a distal portion), an extension portion 26 (e.g., a proximal portion), and a main body portion 28 (e.g., a central portion) extending between the hand portion 24 and the extension portion 26. A lumen 48 may be configured to extend longitudinally through the hand portion 24, the extension portion 26, and the main body portion 28 from the one or more openings (e.g., the first opening 30 and/or other one or more other suitable openings) at the first end portion 22*a* of the body 22 to the one or more openings (e.g., the second opening 32, the third opening 34, and/or one or more other suitable openings) at the second end portion 22*b* of the body 22.

As depicted, the second side 10*b* of the protector 10 may include a seam 38 defined by edges 46. A first piece of material 39 of the body 22, a second piece of material 41 of the body 22, and a third material 43 of the body 22, when included, may come together at or adjacent to the seam 38, but this is not required.

In some cases, the seam 38 may be adjustable between a closed position and an opened position. The seam 38, as shown in FIG. 2, is in an opened position. The seam 38, as shown in FIG. 3, is in a closed position. In some cases, the ability of the seam 38 to open may facilitate a user inserting its hand and/or forearm into body 22 of the protector 10 and/or facilitate producing air flow between the user's skin and the body 22. Closing the seam 38 may facilitate conforming the body 22 to the user's hand and forearm for a snug fit.

The seam 38 may be configured to extend from a location on the body 22 at or adjacent the hand portion 24. In one example, the seam 38 may begin at or adjacent a location on the hand portion 24 of the body 22 that is near a ball of a thumb (e.g., near the thenar muscle) of a user when the user is wearing the protector 10. The seam 38 may extend to a location adjacent to the second proximal terminal end 19, as depicted in FIG. 2, but this is not required and the seam may extend to a different location along a proximal edge 21 of the body 22 or to a different location of the body 22. In some cases the proximal edge 21 of the body may be symmetric about at least one plane extending longitudinally (e.g., axially) along a length of the body 22.

An insert 40 (e.g., a spacer, a flap, or a tongue formed from the third material 43 and/or other suitable flap or tongue) may be provided at and/or underneath the seam 38, such that when the seam 38 is in an opened position, the insert 40 may cover at least a portion of an opening or space between the edges 46 of the seam 38. In one example, the insert 40 may cover all or about all of the space or opening between the edges 46 of the seam 38, as depicted in FIG. 2, but this is not required. The insert 40 may facilitate protecting a user's forearm from being pinched by a closure mechanism 42 as the seam 38 is being opened and/or closed. Further, when the seam 38 is in a closed configuration, the insert 40 may facilitate a snug fit of the protector 10 on the user.

Although not required the seam 38 and/or the insert 40 may be configured to facilitate placement of indicia readable by the wearer of the protector 10 and/or by others viewing the wearer. For example, when the protector 10 is provided in pairs (e.g., one for a right arm and one for a left arm), indicia may be provided on the insert that is readable to a user (i.e., wearer) of the protectors 10 from left to right to indicate on which arm each protector 10 is to be worn. Example types of indicia may include, but is not limited to, brand names, an "R" to indicate right and/or an "L" to indicate left, aesthetic designs, etc.

The closure mechanism 42 may be utilized to facilitate opening and closing the protector 10 along the seam 38. In one example, the closure mechanism 42 may be configured to start at a location on the body 22 at or adjacent the hand portion 24. In some instances, the closure mechanism may begin at or adjacent a location on the hand portion 24 of the body 22 that is configured to be near a ball of a thumb (e.g., near the thenar muscle) of a user when the user is wearing the protector 10.

The closure mechanism 42 may be any suitable type of closure mechanism. As depicted in FIG. 2, the closure mechanism 42 may be a zipper. Alternatively or additionally, the closure mechanism 42 may include, but is not limited to a button closure mechanism, a latching closure mechanism, a lacing closure mechanism, a hook and loop closure mechanism, a snap closure mechanism, a strap mechanism, etc.

As depicted in FIGS. 2 and 3, the hand portion 24 may have a length $L_H$ extending from a distal terminal end of the body 22 to a circumference of an axial location at a distal end of the main body portion 28. The extension portion 26 may have a length $L_E$ extending from a circumference of an axial location at the second proximal terminal end 19 (e.g., at or near a distal-most point of a proximal edge of the body 22) to an axial location at the first proximal terminal end 17 (e.g., at or near a proximal-most point of the proximal edge 21 of the body 22, where the proximal-most point of the proximal edge 21 of the body 22 may be located along a circumference of the proximal edge 21 that is substantially opposite a location of the distal-most point of the proximal edge, but this is not required). The main body portion 28 may have a length $L_M$ extending from a circumference of an axial location at a proximal end of the hand portion 24 to the circumference of the axial location at the second proximal terminal end 19. In some cases, the second proximal terminal end 19 may be adjacent a proximal end of the seam 38, but this is not required.

The proximal edge 21 of the protector 10 may extend around and define, entirely or at least in part, the first opening 30. When so provided, the first proximal terminal end 17 may be located at or adjacent a proximal-most location along the proximal edge 21 of the protector 10 and the second proximal terminal end 19 may be located at or adjacent a distal-most location along the proximal edge 21 of the protector 10, but this is not required. In some cases, the proximal edge 21 may extend circumferentially around the body 22 and extend longitudinally along the body 22 to define the first opening 30.

The lengths of the body 22 and/or the portions of the body 22 may be any suitable lengths configured to protect a user's hand and forearm and facilitate a user comfortably bending their arm while wearing the protector 10. In one example, the length $L_E$ of the extension portion 26 may have a length long enough to extend from a circumference of the body 22 at an axial location of the second proximal terminal end 19 such that the extension portion 26 may extend to an elbow region (e.g., the elbow region 16) of a user wearing the protector 10. The the elbow region of a user may be considered to be a region within a predetermined distance from an elbow of the user. For example, the elbow region may be considered to be a region within about two (2) inches of the elbow, with about one and a half (1.5) inches of the elbow, within about one (1) inch of the elbow, within about a half an inch of the elbow, and/or one or more other suitable predetermined distances relative to an elbow location. In some cases, the length $L_E$ of the extension portion 26 may be configured to extend proximally along a user's arm beyond the elbow and/or the elbow region.

Further, the length $L_M$ of the main body portion 28 and/or a combined length of the length $L_M$ of the main body portion 28 and the length $L_H$ of the hand portion 24 may be configured to ensure the second proximal terminal end 19 is located at or distal of an elbow crease (e.g., the elbow crease 20) of the user wearing the protector 10, but within a predetermined distance from the elbow crease of a user so as to provide suitable protection of a user's forearm. For example, when a user is wearing the protector 10, the length $L_M$ of the main body portion 28 and/or a combined length of the length $L_M$ of the main body portion 28 and the length $L_H$ of the hand portion 24 may be configured such that the second proximal terminal end 19 may be distal of the user's elbow crease and within about one (1) inch or less of the user's elbow crease.

In some cases, a length of the extension portion 26 may be proportional to one or more of the length $L_M$ of the main body portion 28 and/or the length $L_H$ of the hand portion 24. In one example, the length $L_E$ of the extension portion 26 may be within a range of about 0.200 to about 0.400 times a combined length of the main body portion 28 and the hand portion 24 such that the protector 10 provides adequate forearm protection while allowing for a user to freely bend their arm at the elbow. Other suitable proportions are contemplated.

As depicted in FIGS. 2 and 3, the extension portion 26 may have a notched section 44 that may be configured to receive a portion of a user's upper arm when the user's arm is bent at the elbow. The notched section 44 may be defined by the proximal edge 21 and may include the second proximal terminal end 19, such that a distal-most portion of the notched section is located distally of a user's elbow crease when the user is wearing the protector 10 so as not to cause the body 22 to rub against a user's upper arm when the arm is bent at the elbow.

To facilitate receiving a user's upper arm when the user's arm is bent at the elbow, the notched section 44 may have a width W when the seam 38 is in the closed position, as depicted in FIG. 3, such that the user's upper arm may be received in or extend through the notched section 44 without contacting or rubbing against the material of the body 22 and while providing a snug fit for a user. The width W of the notched section 44 may increase in size when the seam 38 is in an opened configuration (e.g., as shown in FIG. 2) relative to when the seam 38 is in a closed configuration (e.g., as shown in FIG. 3), which may facilitate a user inserting a hand and arm into the protector 10 and removing its hand and arm from the protector 10. In some cases, a diameter of the lumen 48 may also increase and decrease with width W of the notched section 44 as the seam 38 moves between the opened configuration and the closed configuration.

Figure 4:
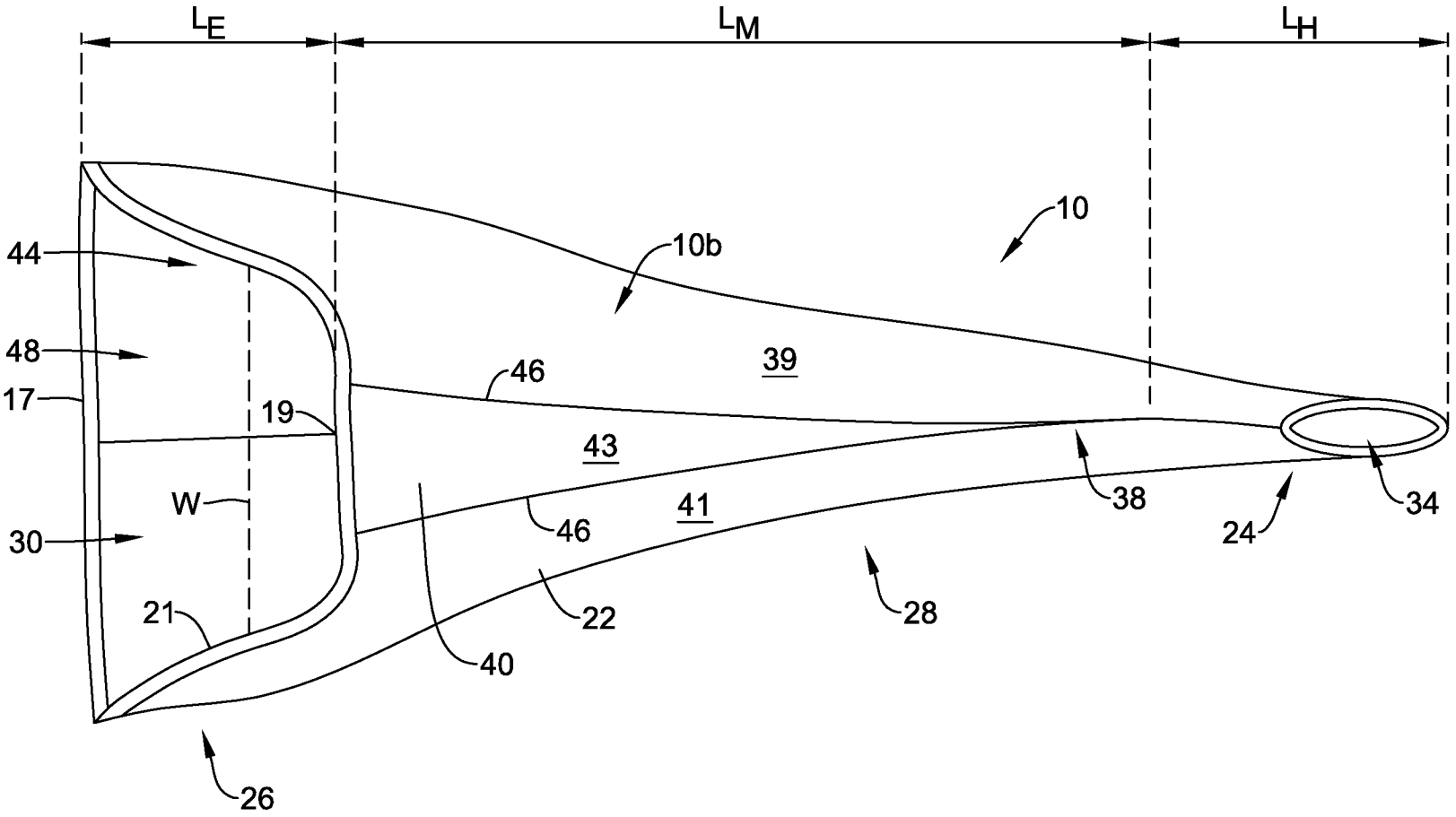
FIG. 4 is a side view of an example protector.

FIG. 4 depicts a side view of a configuration of the second side 10*b* of the protector 10 that may omit the closure mechanism 42. Rather than include the closure mechanism 42 which may form a portion of an exterior of the protector 10, the insert 40 between the edges 46 of the seam 38 may form at least a portion of the exterior of the protector 10. In some instances, when the closure mechanism 42 is omitted, the protector 10 may only have a single configuration as opposed to a closed configuration and an opened configuration when the closure mechanism 42 is included. Omitting the closure mechanism 42 may facilitate providing a protector 10 that may be utilized when working with electrical components and/or high-temperature components (e.g., for welding applications) as potential metallic components of the closure mechanism 42 are omitted.

In some cases, when the closure mechanism 42 is omitted from the protector 10, the protector 10 may be configured to be sized similar to an opened configuration of the protector 10 when the closure mechanism 42 is included such that the protector loosely fits on a user's arm. When the protector 10 is so configured without the closure mechanism 42 or is otherwise in an opened configuration, the protector 10 may facilitate airflow into and/or through the lumen 48, may facilitate quickly removing the protector 10, and/or may have other suitable benefits. In one example, when the protector 10 is configured to loosely fit on a user's arm (e.g., when the closure mechanism 42 is omitted from the protector 10 and/or when the protector includes the closure mechanism 42 and is in an opened configuration), a welder using the protector 10 may quickly remove the protector from its body if hot materials contact the protector and start to burn through material of the protector. This is just one example of a benefit and others are contemplated. Although the protector 10 without a closure mechanism 42 is described as being loose fitting, it is contemplated that the protector 10 without the closure mechanism 42 may be snug (e.g., have a close fit) on a user's hand, wrist, and/or arm.

Figure 5:
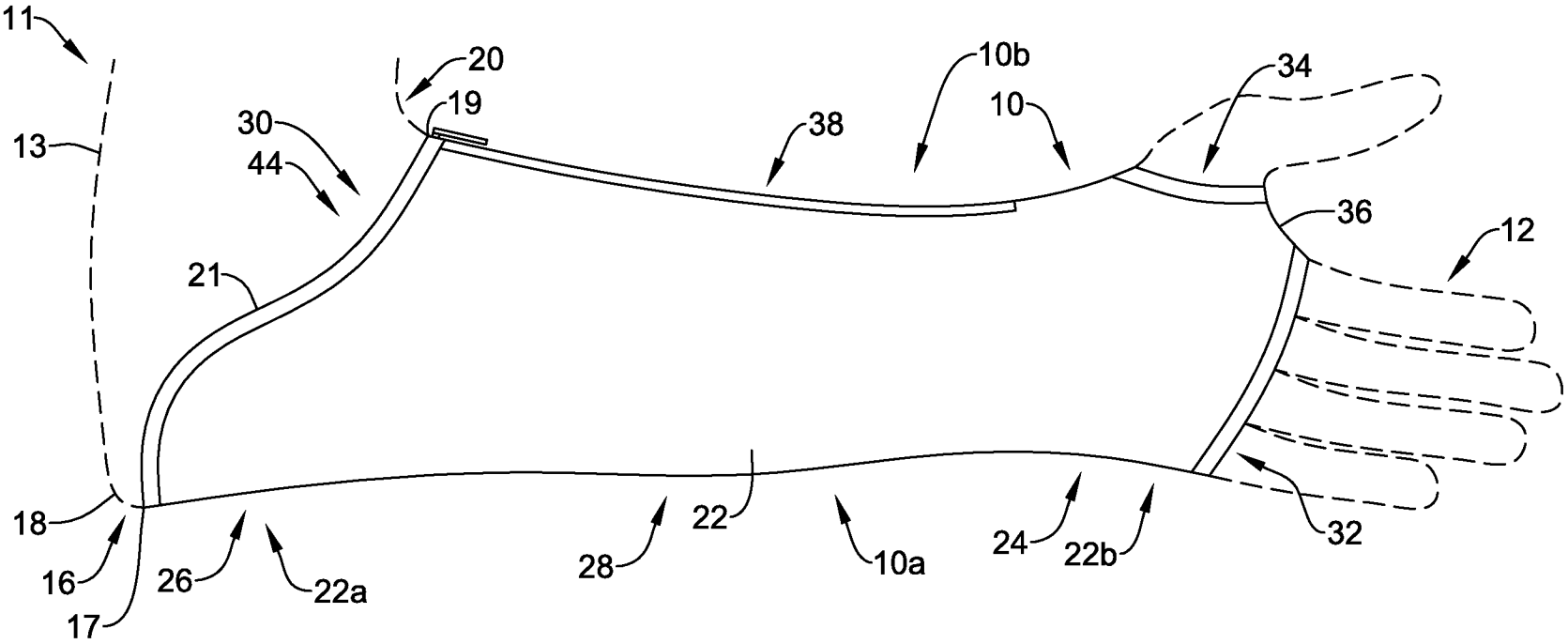
FIG. 5 is a side view of an example protector on a user's arm.

FIG. 5 depicts a side view of the protector 10, with an upper arm 13 of a user extending out of the first opening 30 at a proximal end of the protector 10. The upper arm 13 is shown for environmental purpose only. Although not required, the side views of the protector 10 with the closure mechanism 42 may be identical or substantially identical from a right side view and a left side view. However, it is contemplated that the views may differ in one or more manners. As depicted in FIG. 5, the extension portion 26 of the body 22 may extend to the elbow region 16 and the notched section 44 of the extension portion 26 may facilitate the user bending their arm and may receive the user's upper arm 13.

As depicted in FIG. 5, the proximal edge 21 of the body 22 that is configured to extend at least partially or entirely circumferentially around a user's arm may create an angled transition (e.g., a gradual transition and/or other suitable transition) between the first proximal terminal end 17 and the second proximal terminal end 19 (e.g., a distal-most location along the edge 21 and/or other suitable location along the edge 21). Although only one side of the protector 10 is depicted in FIG. 5, the edge 21, in some cases but not necessarily all, may have a similar shape on the side of the protector 10 not depicted in FIG. 5 (e.g., the edge 21 may be symmetric about a vertical plane extending axially through the protector 10). The angled transition may facilitate support for the extension portion 26, particularly when the extension portion 26 and/or the body 22 is formed from a single layer of material, maintaining its intended configuration, as shown in the Figures. Although it is contemplated straps may be utilized, the angled transition may facilitate support for the extension portion 26 maintaining its intended configuration without the use of straps or other wrap-around support material at, above, or below the elbow 18 and/or the elbow region 16.

In some case, the angled transition between the first proximal terminal end 17 and the second proximal terminal end 19 may be an angled transition that is not a single perpendicular angle there between (e.g., is not a single L-shaped angled transition). Such an angled transition between the first proximal terminal end 17 and the second proximal terminal end 19 may facilitate maintaining the shape of the body 22 such that the extension portion 26 does not fall away from a user's skin without the use of one or more straps and/or other wrap-around material supporting the extension portion 26 at, above, or below the elbow 18 or elbow region 16. Further, the angled transition between the first proximal terminal end 17 and the second proximal terminal end 19 may form a curve (e.g., a smooth curve shape and/or other suitable curve shape) that may mitigate a likelihood of the extension portion catching on brush and/or other objects the user may intentionally or unintentionally interact with when wearing the protectors 10. Other configurations for angled transition are contemplated and included, but are not limited to, a step configuration (e.g., with a plurality of right angles or other angles at each step), a constant angle, etc.

The angled transition defined by the proximal edge 21 may be a smooth curve. In one example, the smooth curve, when included, of the proximal edge 21 may extend downwardly and slightly proximally from the second proximal terminal end 19 and then transition to extending in a more proximal and slightly downwardly direction before returning to extending in a downwardly and slightly proximal direction until the proximal edge 21 reaches first proximal terminal end 17. In some cases, the angled transition defined by the proximal edge 21 may be considered an S-shape, but this is not required.

Those skilled in the art will recognize that the present disclosure may be manifested in a variety of forms other than the specific embodiments described and contemplated herein. For instance, as described herein, various embodiments include one or more components described as performing various functions. However, other embodiments may include additional components that split the described functions up over more components than that described herein. Additionally, other embodiments may consolidate the described functions into fewer components.

Although various features may have been described with respect to less than all embodiments, this disclosure contemplates that those features may be included on any embodiment. Further, although the embodiments described herein may have omitted some combinations of the various described features, this disclosure contemplates embodiments that include any combination of each described feature. Accordingly, departure in form and detail may be made without departing from the scope and spirit of the present disclosure as described in the appended claims.

What is claimed is:

1. A hand and forearm protector comprising:

a main body portion configured to extend along and around a forearm of a user;

a hand portion extending distally from the main body portion;

an extension portion extending proximally from the main body portion and configured to extend to a location adjacent an elbow region of the user; and an edge circumferentially defining a proximal edge of the extension portion, the edge having a notched section configured to receive an upper arm of the user when an arm of the user is bent at an elbow; and wherein the edge extends upwardly and distally in a convex curve from a proximal position, transitions from the upwardly and distally extending convex curve to an upwardly and distally extending concave curve, transitions from the upwardly and distally extending concave curve to a downwardly and proximally extending concave curve, transitions from the downwardly and proximally extending concave curve to a downwardly and proximally extending convex curve, and returns to the proximal position.

2. The hand and forearm protector of claim 1, wherein the edge is configured to extend from a location adjacent an elbow of a user on a first side of the extension portion to a location adjacent an elbow crease of a user on a second side of the extension portion when the main body portion extends along and around the forearm of the user and fingers of a hand of the user extend through the hand portion.

3. The hand and forearm protector of claim 1, wherein a proximal-most edge of the extension portion is configured to extend to a location within one (1) inch of an elbow of the user when the main body portion extends along and around the forearm of the user and fingers of a hand of the user extend through the hand portion.

4. The hand and forearm protector of claim 1, wherein the edge forms an angled transition between a location along the notched section and a proximal-most location along the edge.

5. The hand and forearm protector of claim 4, wherein the angled transition forms a smooth curve between the location along the notched section and the proximal-most location along the edge, the proximal-most location along the edge is the proximal position.

6. The hand and forearm protector of claim 4, wherein the location along the notched section is a distal-most location along the edge.

7. The hand and forearm protector of claim 1, wherein the extension portion has a length on its longest side that is within a range of 0.200 and 0.400 times a combined length of the main body portion and the hand portion.

8. The hand and forearm protector of claim 1, further comprising:

a lumen extending distally from the notched section of the edge and along the main body portion; and a closure mechanism configured to adjustably change a diameter of the lumen in response to adjusting the closure mechanism between an opened configuration and a closed configuration.

9. The hand and forearm protector of claim 1, further comprising:

a lumen extending distally along the main body portion from the notched section of the edge; and an insert connected to longitudinally extending edges of a seam, the insert is configured to define the lumen and define the notched section.

10. The hand and forearm protector of claim 1, wherein the hand portion comprises a first discrete digit opening configured to receive a plurality of fingers of the user and a second discrete digit opening configured to receive a thumb of the user.

11. An arm protector:

a body having a first end, a second end, a lumen extending between the first end and the second end;

a first opening at the first end, the lumen configured to receive a hand and an arm of a user through the first opening;

a second opening at the second end, the second opening configured to receive the hand of the user; and an edge of the body defining the first opening; and wherein the edge extends circumferentially around the body and longitudinally along the body so as to extend upwardly and distally in a convex curve from a proximal position, transition from the upwardly and distally extending convex curve to an upwardly and distally extending concave curve, transition from the upwardly and distally extending concave curve to a downwardly and proximally extending concave curve, transition from the downwardly and proximally extending concave curve to a downwardly and proximally extending convex curve, and return to the proximal position.

12. The arm protector of claim 11, wherein the edge defines a transition between a distal-most point along the edge and a proximal-most point along the edge.

13. The arm protector of claim 12, wherein a location of the distal-most point along the edge is circumferentially opposite a location of the proximal-most point along the edge.

14. The arm protector of claim 12, wherein the transition is formed by a curve defined by the edge.

15. The arm protector of claim 12, wherein the edge is symmetric about at least one plane extending longitudinally along the body between the distal-most point along the edge and the proximal-most point along the edge.

16. The arm protector of claim 11, further comprising:

longitudinally extending edges of the body, the longitudinally extending edges extending distally along the body from the first opening; and an insert connected to the longitudinally extending edges, the insert configured to extend between the longitudinally extending edges and define the first opening.

17. The arm protector of claim 16, further comprising:

an adjustable closure mechanism configured to adjustably connect the longitudinally extending edges over the insert.

18. The arm protector of claim 11, wherein the edge defines a notched section in the body.

19. A protector comprising:

a body having a first end, a second end, a lumen extending between the first end and the second end;

a first opening at the first end, the lumen configured to receive a hand and an arm of a user through the first opening;

an edge of the body defining the first opening and a proximal terminal end of the body; and a second opening at the second end, the second opening configured to receive the hand of the user; and wherein the body is configured to protect a forearm of the user from a location proximate an elbow of the user to the hand of the user, while facilitating bending of the arm of the user at the elbow; and wherein the edge extends downwardly and proximally at first slope from a first position, transitions from the first slope to extending downwardly and proximally at a second slope that is less than the first slope, and transitions from the second slope to extending downwardly and proximally at a third slope to a second position, the third slope is greater than the second slope and the second position circumferentially opposes the first position.

20. The protector of claim 19, further comprising:

wherein the edge is configured to extend from an elbow region of the user to a location adjacent an elbow crease of the user when the arm of the user is bent and maintain a configuration of a portion of the body extending to the location adjacent the elbow of the user.

* * * * *